US007934326B2

(12) United States Patent
Sartor

(10) Patent No.: US 7,934,326 B2
(45) Date of Patent: May 3, 2011

(54) SKI BOOT THAT CAN BE ADAPTED FOR TOURING

(75) Inventor: Paolo Sartor, Montebeluna (IT)

(73) Assignee: Lisa Lange International SARL, Fribourg (CH)

( * ) Notice: Subject to any disclaimer, the term of this patent is extended or adjusted under 35 U.S.C. 154(b) by 929 days.

(21) Appl. No.: 11/725,883

(22) Filed: Mar. 20, 2007

(65) Prior Publication Data

US 2007/0220780 A1 Sep. 27, 2007

(30) Foreign Application Priority Data

Mar. 24, 2006 (EP) ..... 06425203

(51) Int. Cl.
*A43C 13/00* (2006.01)
*A43B 5/04* (2006.01)

(52) U.S. Cl. ..... 36/117.3; 36/15; 36/115

(58) Field of Classification Search ..... 36/15, 100, 36/97, 117.3, 115, 117.1, 117.2, 117.4; 280/614, 280/615, 616, 617, 618
See application file for complete search history.

(56) References Cited

U.S. PATENT DOCUMENTS

| | | | | |
|---|---|---|---|---|
| 4,032,172 | A * | 6/1977 | Pyzel et al. | 280/615 |
| 4,351,120 | A | 9/1982 | Dalebout | |
| 4,392,666 | A * | 7/1983 | Ramer | 280/614 |
| 4,542,599 | A | 9/1985 | Annovi | |
| 4,770,441 | A * | 9/1988 | Demonsant et al. | 280/818 |
| 4,811,504 | A | 3/1989 | Bunke | |
| 4,887,833 | A * | 12/1989 | Bailey | 280/615 |
| 6,065,228 | A | 5/2000 | Begey et al. | |
| 6,286,855 | B1 | 9/2001 | Paris | |
| 6,609,313 | B2 * | 8/2003 | Orso | 36/117.3 |
| 6,685,213 | B2 * | 2/2004 | Hauglin | 280/624 |
| 6,868,624 | B1 * | 3/2005 | Trinkaus | 36/117.1 |
| 2005/0212263 | A1 * | 9/2005 | Steffen et al. | 280/619 |
| 2005/0248128 | A1 * | 11/2005 | Hauglin | 280/617 |

FOREIGN PATENT DOCUMENTS

| | | |
|---|---|---|
| EP | 0 510 384 A | 3/1992 |
| EP | 0 642 748 A | 8/1994 |
| EP | 0 642 748 B | 4/1997 |
| EP | 0 510 384 B | 6/1997 |
| EP | 0815 756 A | 1/1998 |
| EP | 0 815 756 B | 3/2002 |
| FR | 2 743 700 | 1/1996 |
| FR | 2 774 266 | 8/1999 |
| IT | 1 220 793 | 2/1988 |
| IT | 1 257 619 | 2/1996 |

* cited by examiner

*Primary Examiner* — Jila M Mohandesi
(74) *Attorney, Agent, or Firm* — Frommer Lawrence & Haug LLP; Ronald R. Santucci

(57) ABSTRACT

A ski-boot assembly with a rigid upper, an incomplete sole of the upper, and a front and/or rear means for cooperation with a removable sole assembly. A first removable sole assembly includes at least one curb part and a bearing plat; and a cooperation means that complements the front and/or rear cooperation means of the incomplete sole to form a boot with a sole whose configuration corresponds to standard ISO 5355 for Alpine ski-boots. A second removable sole assembly has at least one curb part and a sole cooperation means that complements the front and/or rear cooperation means of the incomplete sole to form a boot with a sole whose configuration corresponds substantially to standard ISO 9523 for touring boots. A locking means locks the first or the second removable sole assembly under the incomplete sole of the upper and includes a manual actuating means.

20 Claims, 12 Drawing Sheets

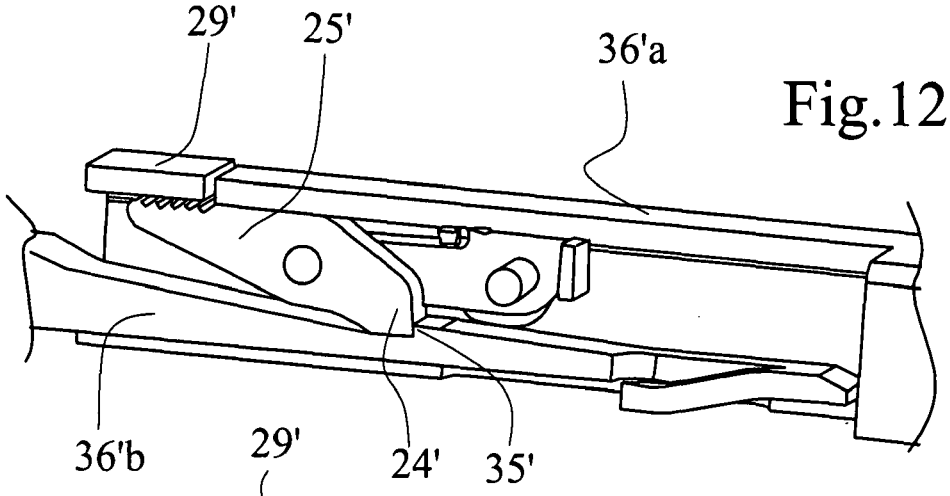
Fig.12
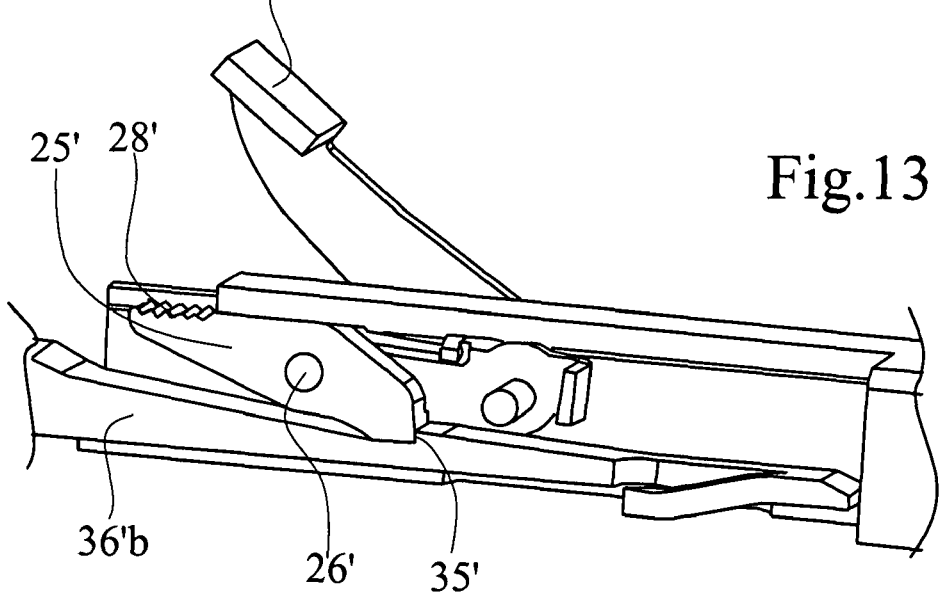
Fig.13
Fig.14
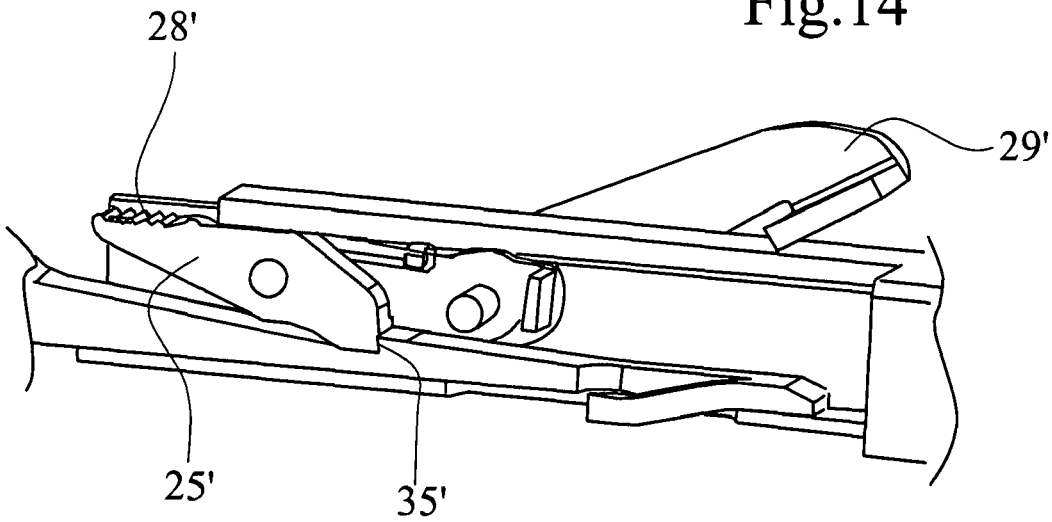

SKI BOOT THAT CAN BE ADAPTED FOR TOURING

This application claims priority benefits from European Patent Application No. EP 06425203.4 filed Mar. 24, 2006.

BACKGROUND OF THE INVENTION

The present invention relates to a boot assembly of the ski-boot type, conforming to standard ISO 5355 for Alpine ski-boots, that can be adapted to touring by means of a conversion of its sole, in order to comply substantially with standard ISO 9523 for touring boots.

DESCRIPTION OF THE PRIOR ART

The problem of adapting a ski boot to walking mode is one of very long standing since a skier inevitably needs to walk while wearing his ski boots, either to reach the bottom of the mechanical lifts from the parking lot or his hotel or to reach a higher altitude not served by mechanical lifts.

A first solution, described in document U.S. Pat. No. 4,811,504, discloses a removable walking sole that is fitted over a standard ski boot. The advantage of this solution is that it offers a standard ski boot and thus, by definition, a boot fully adapted to skiing. Its drawback is that the solution does not provide a very high performance level for walking.

A different solution is described in document U.S. Pat. No. 4,542,599, in which a boot that is better adapted to walking is disclosed, a removable sole being added for skiing. The drawback of this solution is still that it is not possible to obtain an optimum solution for walking mode. Furthermore, skiing is unsafe because the removable sole, which occupies the entire lower surface of the boot plus the lateral edges, is difficult to fix satisfactorily and risks becoming detached when stressed while skiing.

A further prior-art document (FR2743700) discloses a sports boot for a gliding device that can be adapted to walking mode by the provision of removable front and rear means under the sole of the boot. Bearing plates are provided laterally under the boot, which are capable of interacting with special complementary plates of a ski binding. Slides are provided under the boot for fixing the removable parts. No means for locking the removable parts is described and screws are needed to hold them under the boot. A drawback of this solution arises from its incompatibility with existing standards. Indeed, it requires non-standard ski bindings with specific bearing plates. This system is more dangerous because it is ineffective in terms of the release action that allows the boot to be freed in the event of a twisting fall. Furthermore, when skiing, the removable parts interact on the front and the rear of the boot with the jaws of the ski binding and undergo very high stresses, which give rise to wear of the slides, resulting in the appearance of play between the removable part and the boot, which becomes detrimental to satisfactory guiding of the gliding device. Similarly, this solution does not make it possible to achieve a walking boot compliant with current standards. Lastly, it also requires a tool for the boot-conversion operations, which is not user-friendly.

In order to palliate the above drawbacks, a different solution is proposed in document FR2774266, which allows adaptation of a conventional ski boot to ski touring, for example, on the basis of a modification of the lower part of the sole only. Fixing elements, such as screws, are provided in order to hold the removable plates under the sole. The drawback of this solution arises from its non-user-friendliness, since adaptation of the boot requires a tool. Furthermore, as a small thin part is modified under the boot, this solution does not allow major adaptation of the boot. Indeed, the curbs still have the same dimensions, for example. Thus, this approach does not allow an adaptation of the boot compliant with or approaching the touring boot standard.

Lastly, there are further solutions somewhat removed from this specific subject that are disclosed in documents IT1220793 and IT1257619, which disclose front and rear parts of removable ski-boot soles to allow their adaptation to different sizes. These solutions also require screws for locking them, which is not user-friendly. These screws are screwed directly into the rigid plastic positioned under the sole of the boot and this device is not suited to numerous conversion operations because the plastic wears very quickly, becoming non-operational. Furthermore, said solutions do not address the adaptation of the boot to walking mode.

Nowadays, ski professionals, first-aiders or members of ski patrol, for example, and recreational high-mountain skiers need to access slopes that are not directly served by conventional mechanical lifts. They therefore need to walk at altitude to reach those slopes, which requires a high-performance walking boot, ideally a standard hiking boot, whose form is naturally optimized for walking and furthermore allows special adaptations with the aid of accessories, such as crampons, for example, which are not compatible other than with these standard hiking boots. Such skiers then put on their skis and descend what are frequently hazardous slopes. They thus also require a very high-performance and secure way in which to fix their boot to the ski. Existing touring ski-boot bindings are unsatisfactory. Such skiers in fact ideally require a standard ski boot combined with a standard Alpine ski binding. As observed previously, no prior-art solution meets this requirement satisfactorily.

SUMMARY OF THE INVENTION

A general object of the invention thus consists in providing a boot assembly that performs at a high level for both touring at high altitude and skiing downhill, one that is user-friendly and compact and, for example, eliminates the need to have two pairs of boots to carry and a different pair of skis for each type of boot.

More precisely, a first subject of the invention thus consists in a boot assembly that is sufficiently rigid to provide a good transmission of the skier's forces to a board for gliding, and which comprises standard bearing plates and curbs for interacting with the customary bindings provided on skis and can withstand the forces that arise under conditions of extreme use of the ski.

A second subject of the invention consists in a boot assembly that allows hiking-type walking at altitude, offering, in particular, satisfactory rolling of the foot and the opportunity to add on standard accessories such as crampons.

A third subject of the invention consists in a compact boot assembly in which the ski/walking mode conversion is easy and user-friendly, and can be implemented a great many times without giving rise to significant wear irrespective of the location and external conditions.

The invention is based on a boot assembly that comprises a rigid upper of the ski-boot type under which there is an incomplete sole capable of receiving at least a front and/or rear part of a removable sole, which can be positioned and locked mechanically, securely and without a specific tool, under this incomplete sole of the upper in order to complete it, the geometry of the incomplete sole of the rigid upper and of the removable sole parts being such that it is possible to comply not only with standard ISO 5355 for Alpine ski-boots but also substantially to comply with the requirements of standard ISO 9523 for touring boots. Fixing of the removable sole to the rest of the boot is such that it is also reliable and secure, just as if it were carried out with the aid of a number of screws, without presenting the drawback of the screwing operation that gives rise to rapid wear and is unsuitable for use on a great many occasions when there are series of fitting and removal operations.

The invention is more precisely defined by the claims.

DESCRIPTION OF THE DRAWINGS

These objects, characteristics and advantages of the present invention will be set forth in detail in the following description of particular non-limiting embodiments that relate to the appended figures, in which:

FIGS. 12 to 17 show perspective views sectioned by a vertical longitudinal plane of details of the sole-locking device in different configurations in accordance with the second variant of the second embodiment of the invention;

DESCRIPTION OF THE PREFERRED EMBODIMENTS

Figure 1:
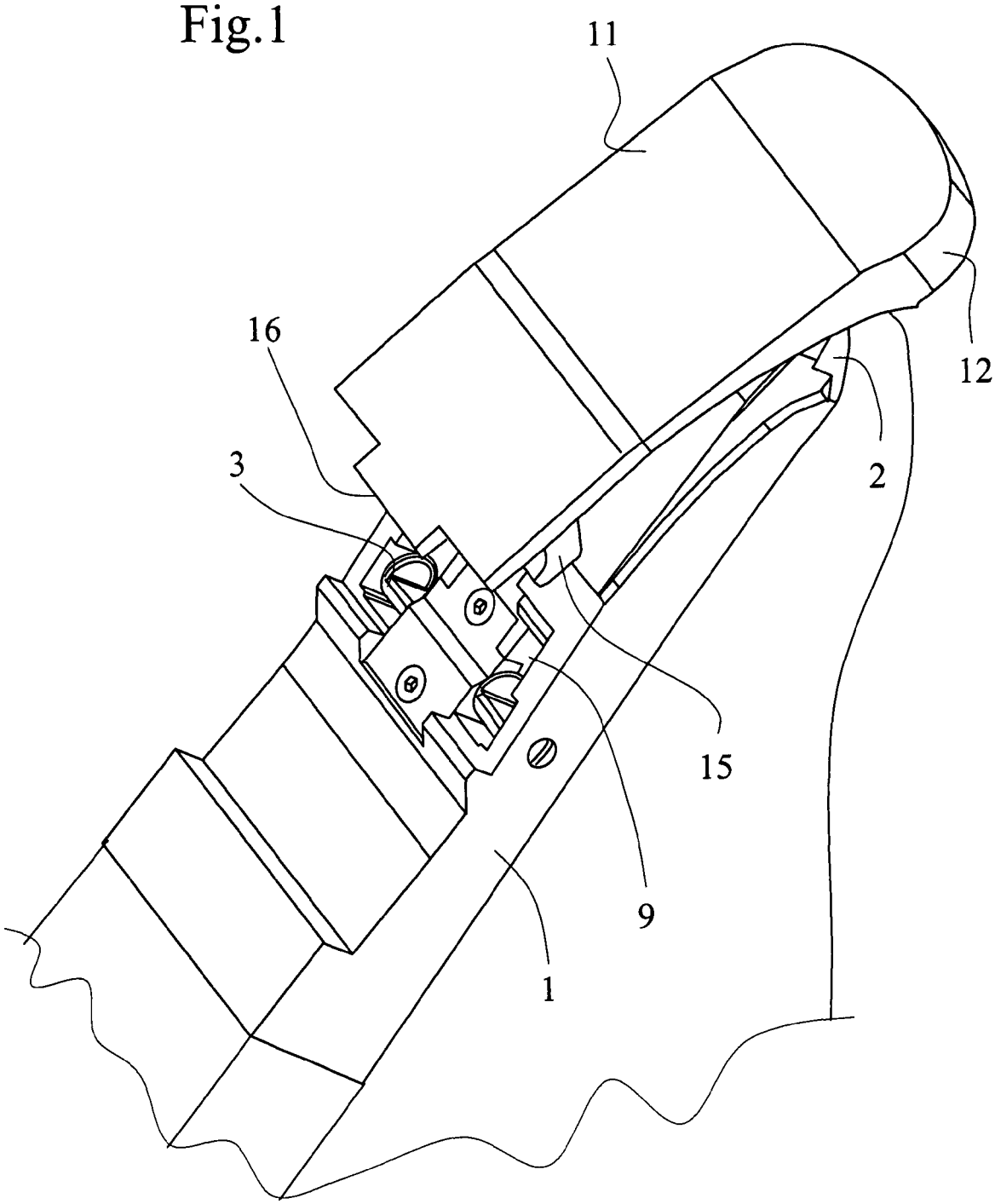
FIG. 1 shows a partial perspective bottom view of a first removable sole element in a step in which it is being fixed to the incomplete sole of the boot upper in accordance with a first embodiment of the invention.
Figure 2:
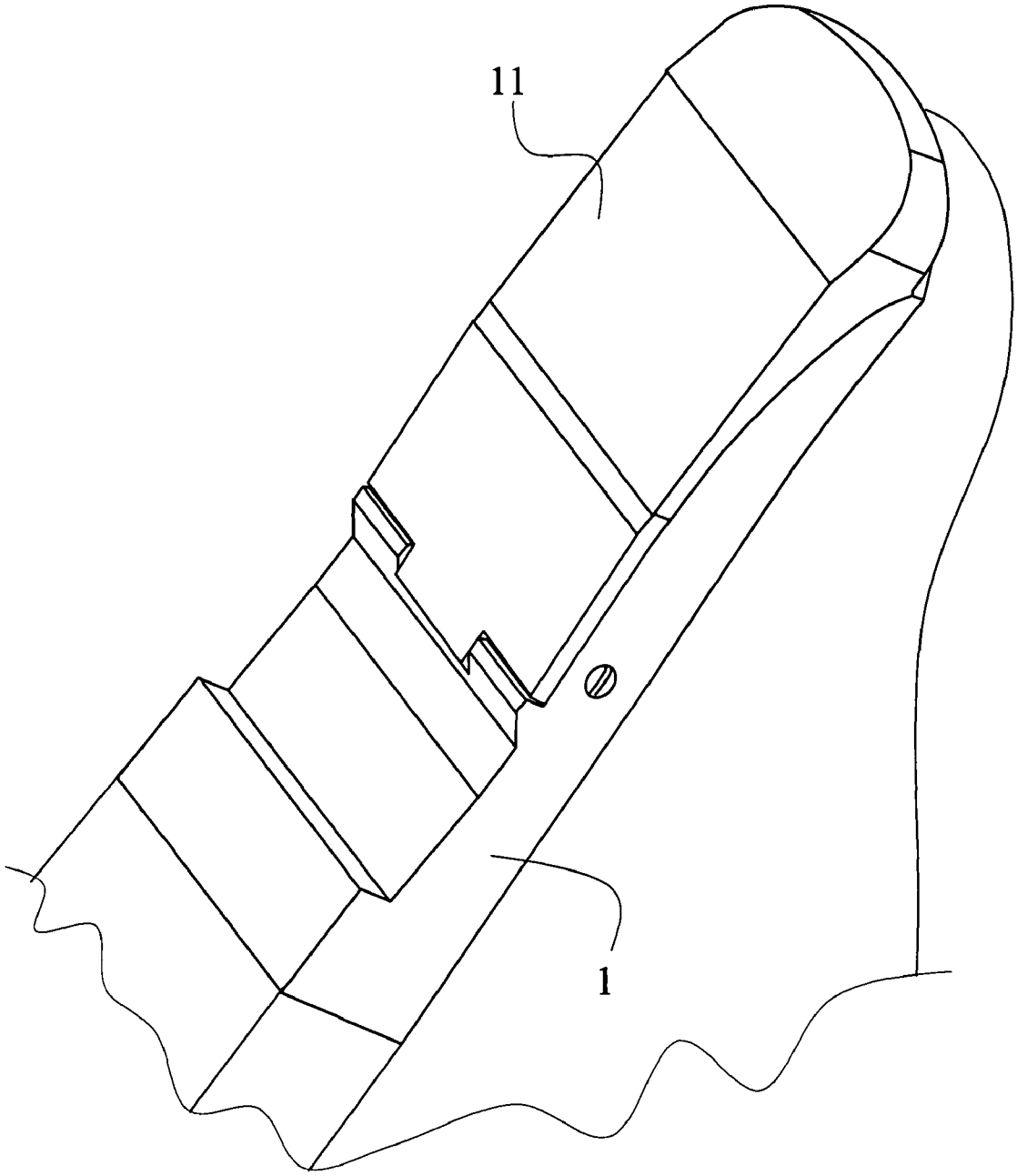
FIG. 2 shows a partial perspective bottom view of a first removable sole element after it has been fixed to the incomplete sole of the boot upper in accordance with a first embodiment of the invention.
Figure 3:
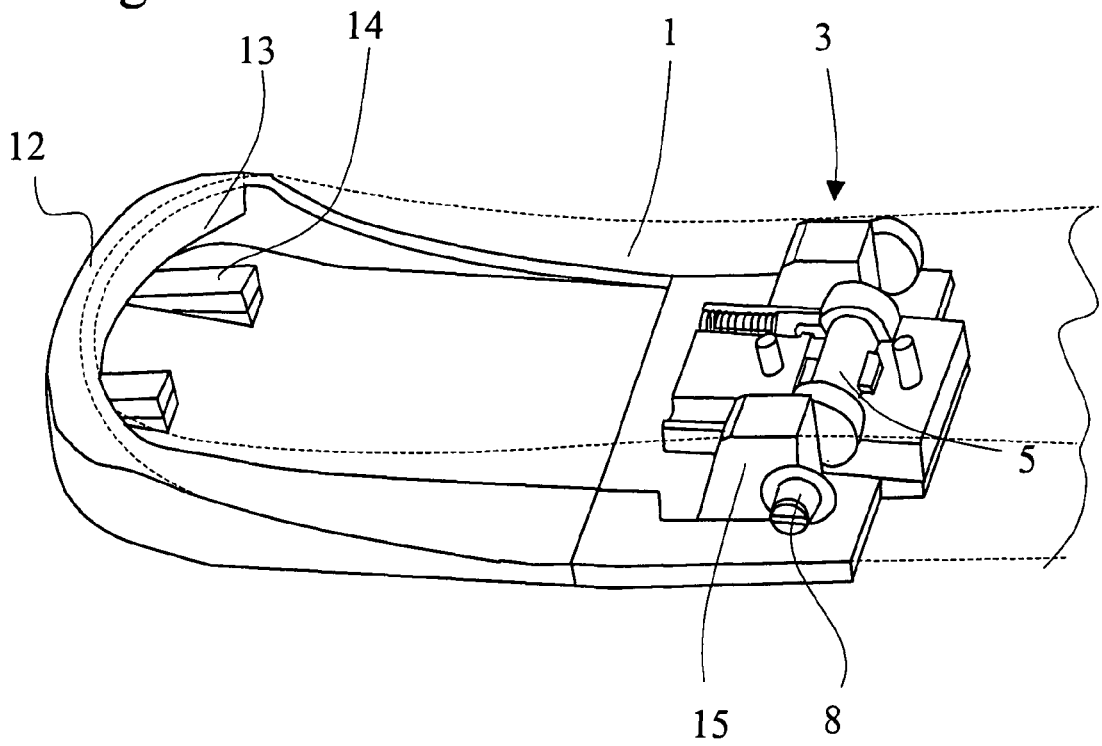
FIG. 3 shows a partial perspective top view of a first removable sole element after it has been fixed to the incomplete sole of the boot upper in accordance with a first embodiment of the invention.
Figure 4:
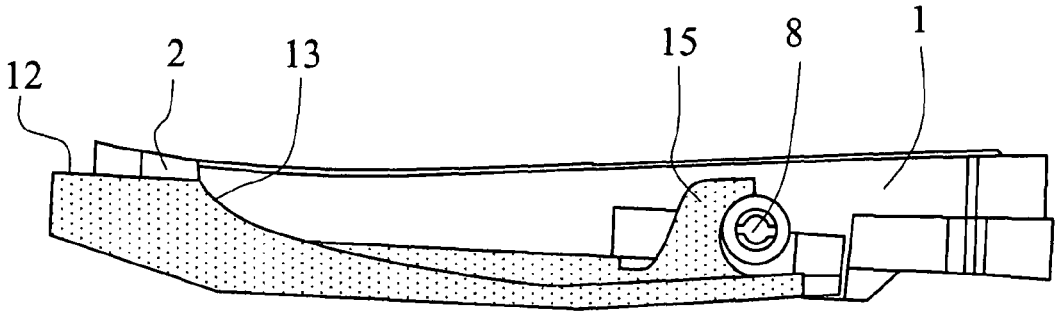
FIG. 4 shows a partial side view of a first removable sole element after it has been fixed to the incomplete sole of the boot upper in accordance with a first embodiment of the invention.
Figure 5:
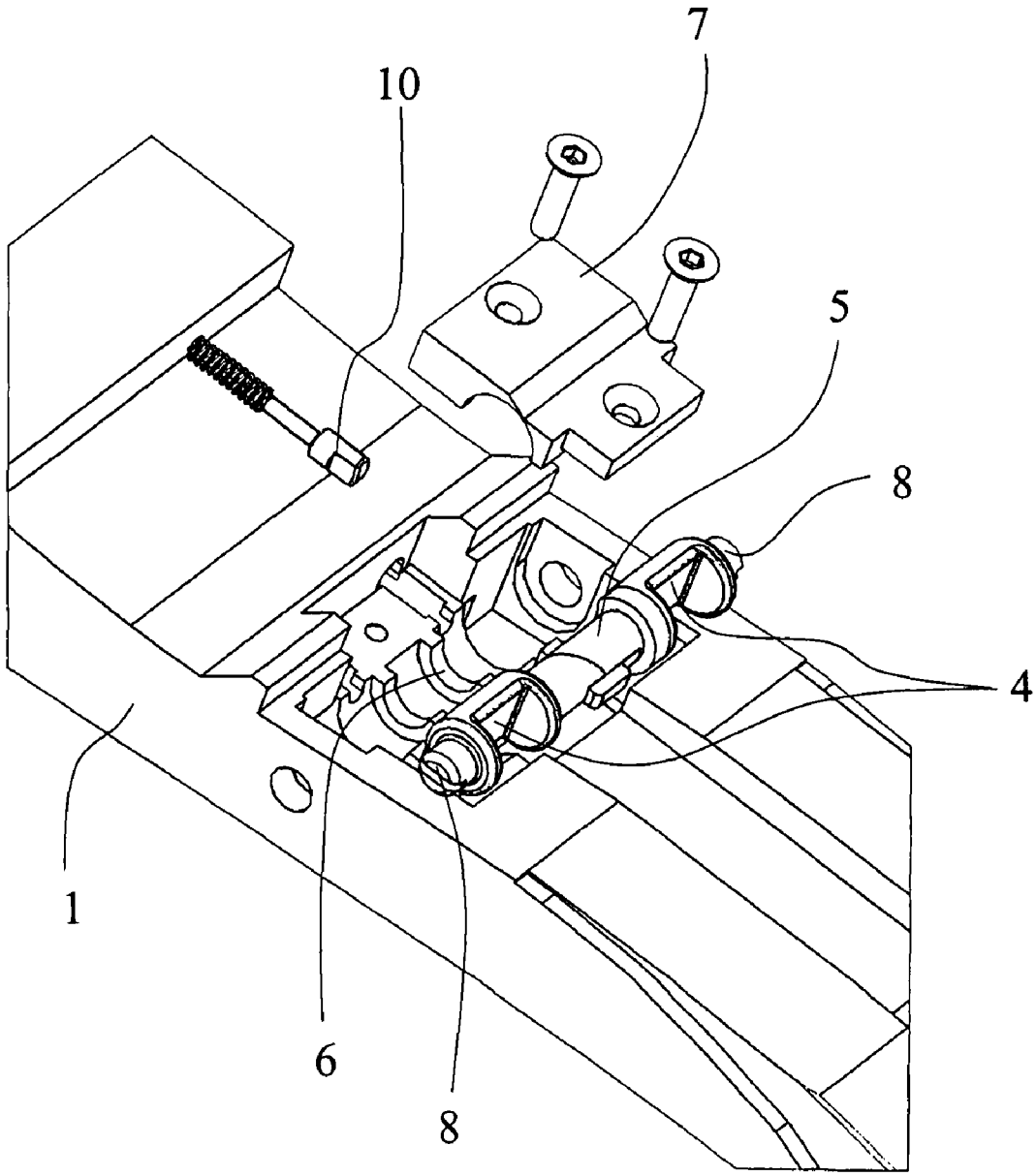
FIG. 5 shows a partial perspective bottom view of the partially dismantled fixing mechanism of the incomplete sole of the boot upper in accordance with a first embodiment of the invention.
Figure 6:
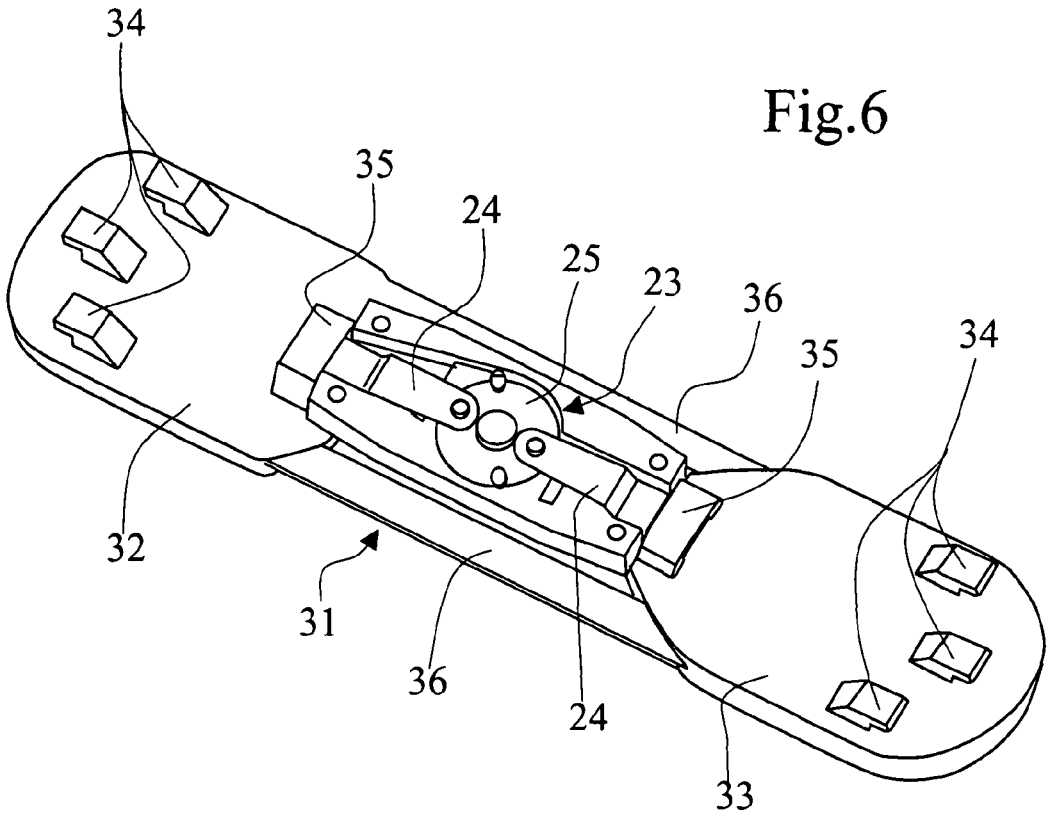
FIG. 6 shows a partial perspective top view of the sole of the boot in accordance with a first variant of a second embodiment of the invention.
Figure 7:
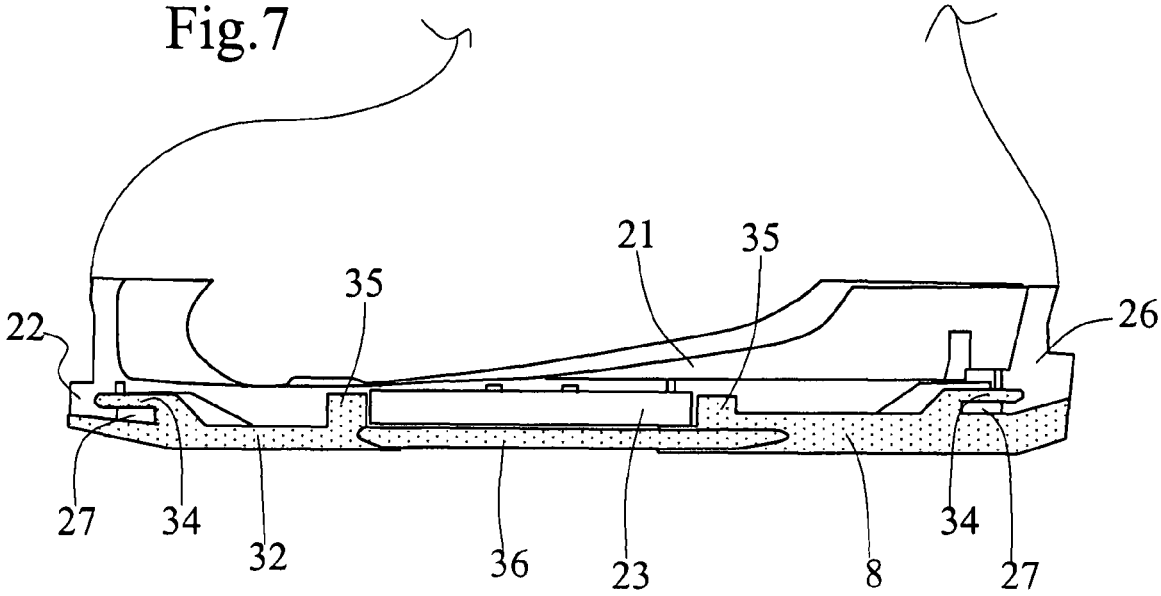
FIG. 7 shows a partial side view of the boot in accordance with a second embodiment of the invention.
Figure 8:
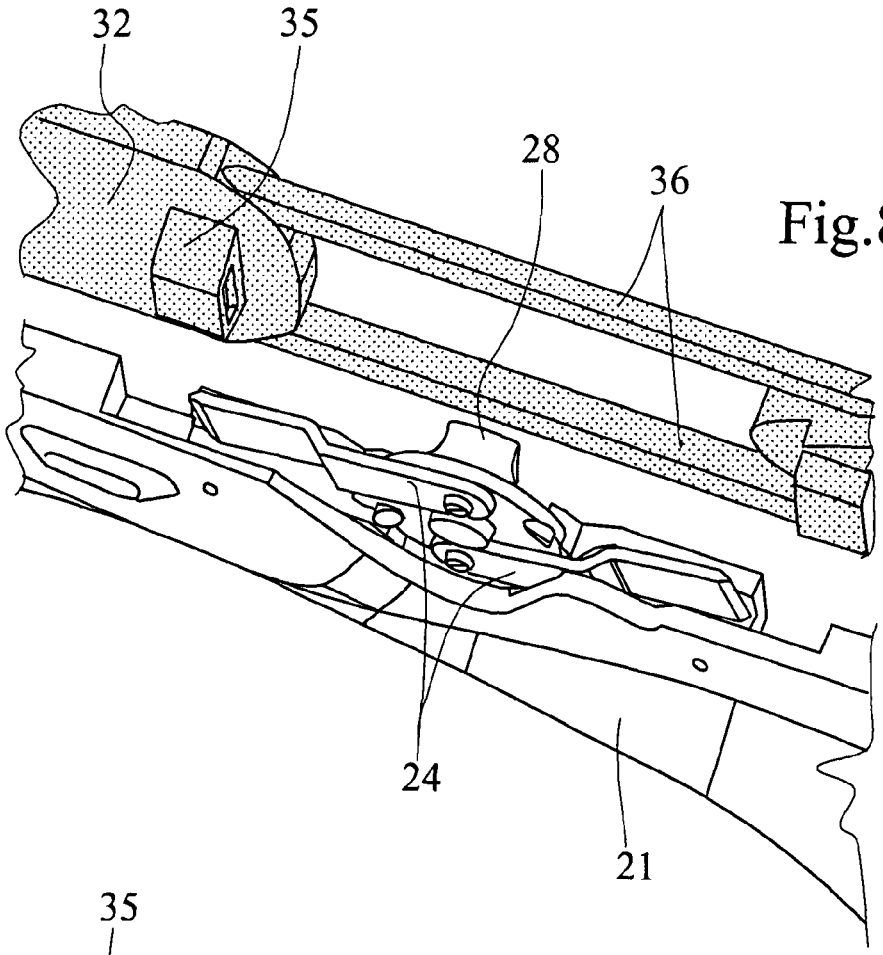
FIGS. 8 to 10 show perspective views of details of the sole-locking device in different configurations in accordance with a second embodiment of the invention.
Figure 9:
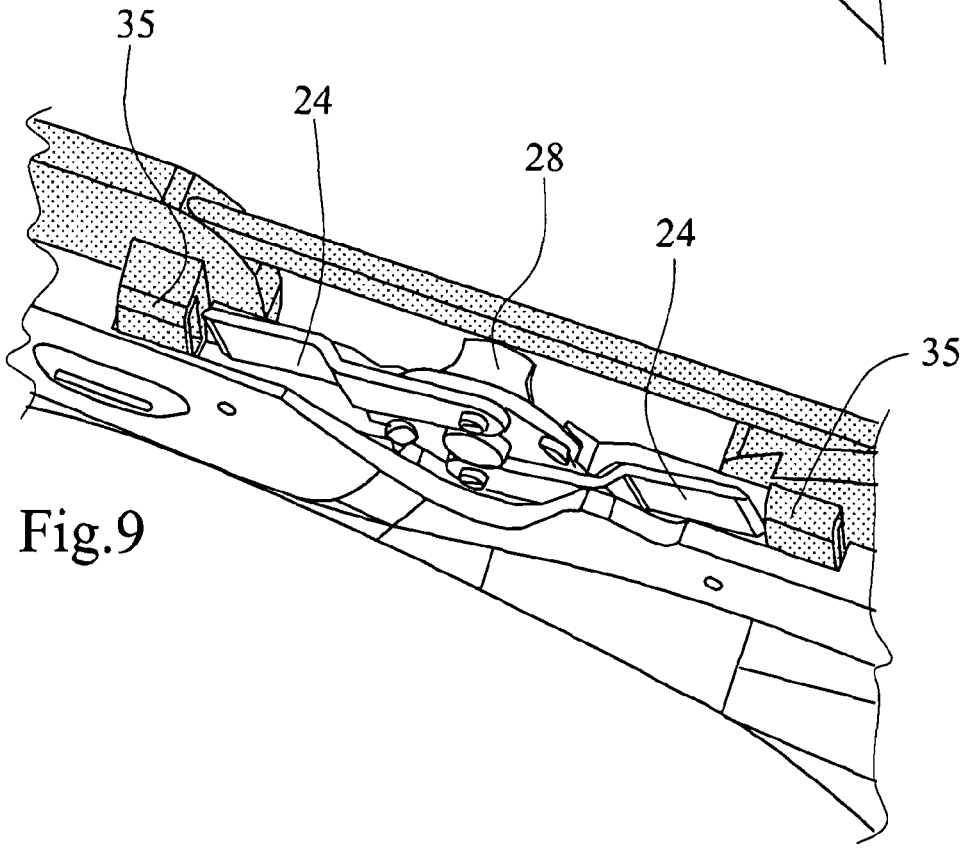
Figure 10:
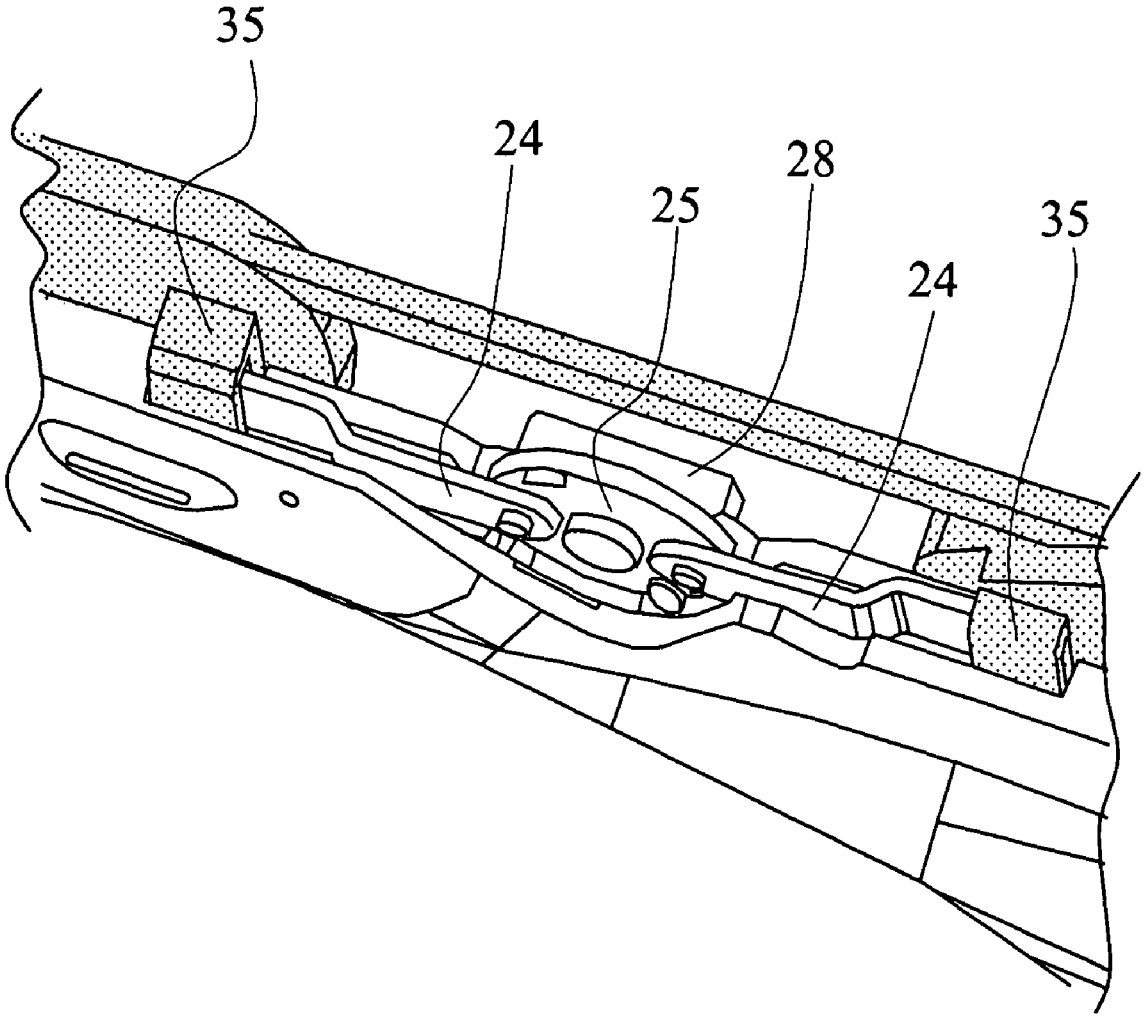
Figure 11:
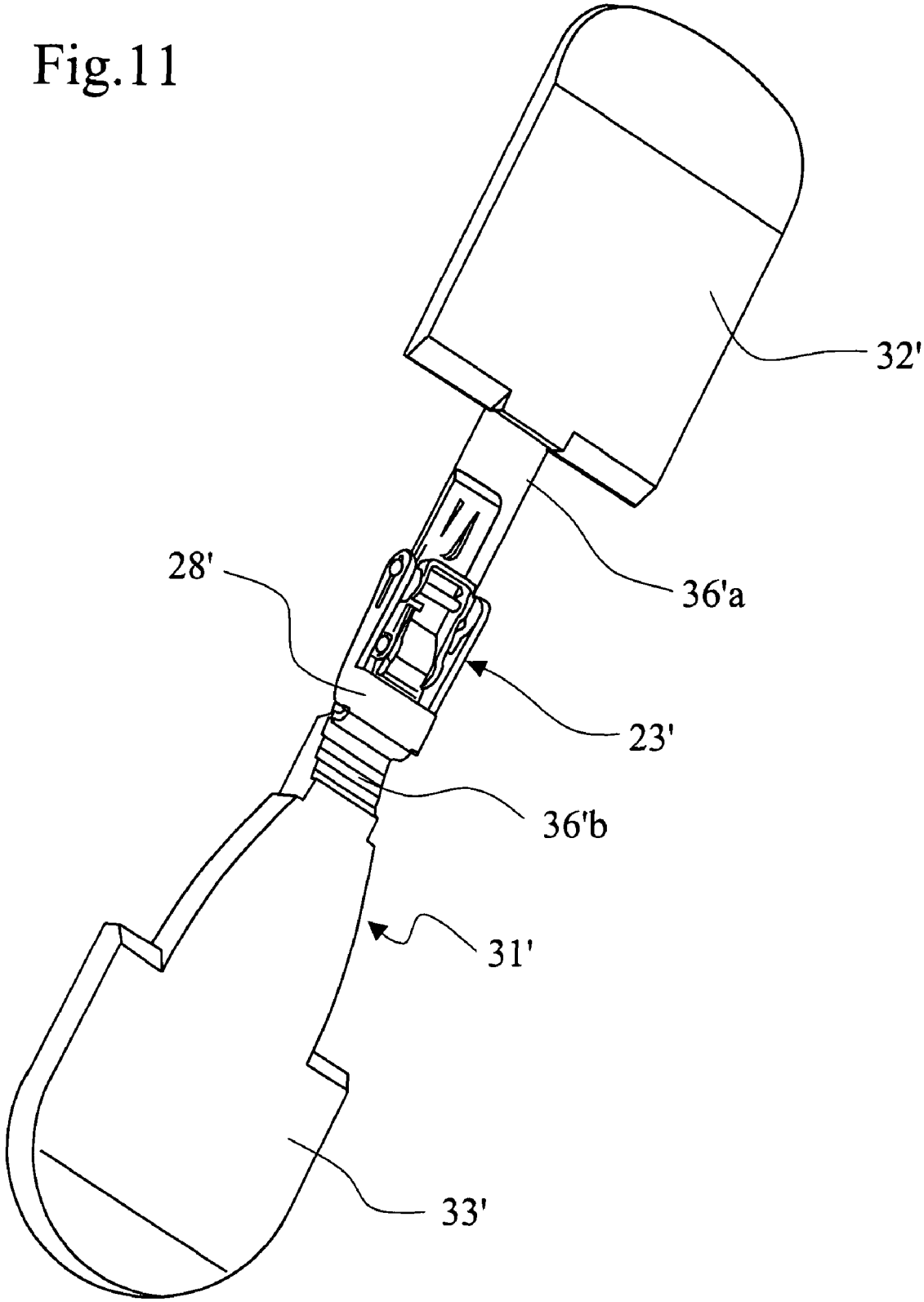
FIG. 11 shows a partial perspective bottom view of the boot in accordance with a second variant of a second embodiment of the invention.
Figure 15:
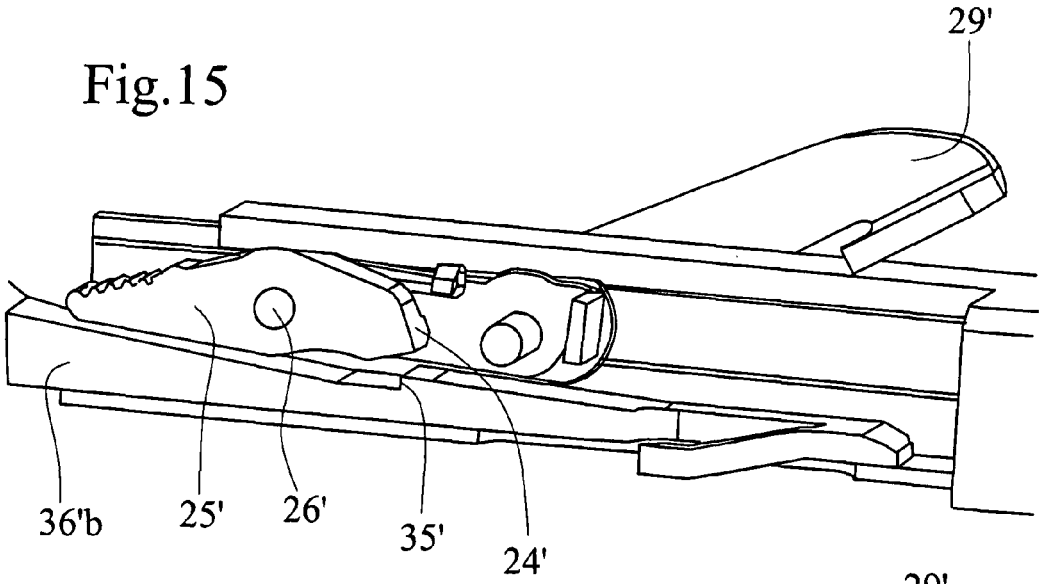
Figure 16:
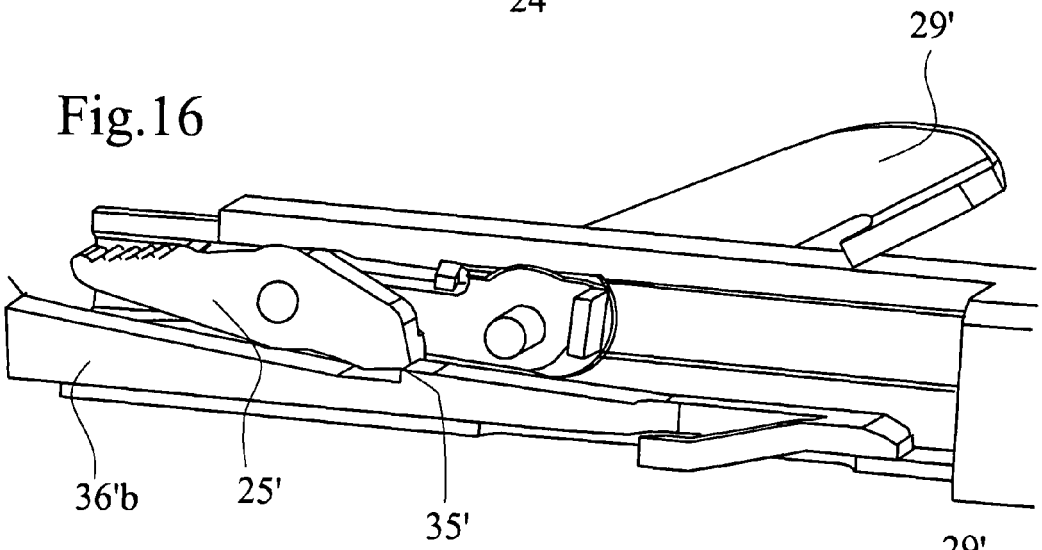
Figure 17:
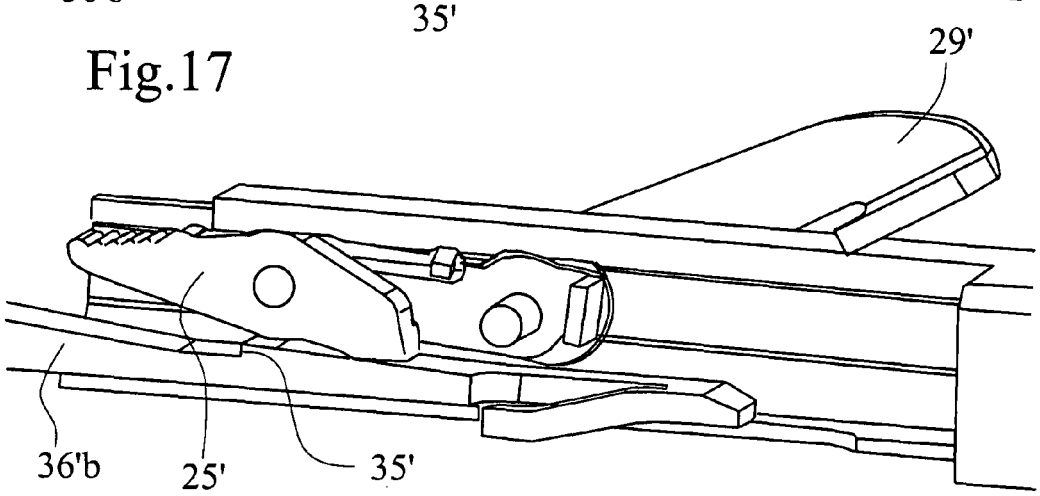

The major concept of the solution proposed consists in being able to obtain, on the basis of a standard ski boot, by means of a simple conversion without a special tool and without significantly affecting certain parts of the boot or of the sole, a substantial modification of the sole of the boot in order to render it compatible with the ISO standard for touring boots.

To recap, the standard sole of hiking boots is made from a flexible rubber-type material forming studs on its underside in order to provide good grip on the ground, and has a rounded front shape in order to allow satisfactory rolling of the foot during walking and a front curb height unlike that of a standard ski-boot sole that is made from a rigid material for providing a good link with a ski binding, and furthermore has a flat, smooth lower surface with sliding surfaces called "bearing plates" that are necessary for implementing the release function that consists in freeing the boot from the grip of a ski binding, for safety reasons, in the event of a fall.

A first significant element of the solution is thus that it allows substantial conversion of the geometry of the sole of the boot in order to achieve the major conversion of the ISO standard for Alpine ski-boots to touring boots, in which there are significant differences. To that end, the solution is based on three principal elements: an initial upper that has only an incomplete sole and two removable sole assemblies of different geometry that can be fixed to and combined with said incomplete sole in order to form an operational boot that has a sole configuration either of a ski boot or of a hiking boot. Depending on the solution, the two removable sole assemblies thus form a significant part of the final sole obtained and, in particular, form a major part or even all of the front and possibly rear curbs of the boot finally obtained.

Furthermore, a second major element of the concept of the invention arises from the fact that this conversion must be possible on a great number of occasions, which rules out, for example, any solution comprising a screwing operation into the plastic of the boot itself, since such an operation gives rise to rapid wear. Lastly, this fixing of the removable soles has to be easy, rapid and secure so that fitting can be carried out automatically under all circumstances, at any location and irrespective of the weather conditions, for example, while still obtaining a result that guarantees that the attached removable soles will not become detached from the boot during a phase involving intensive forces when walking or when skiing downhill.

The following embodiments illustrate, by way of examples, possible combinations of a removable sole according to the invention and an incomplete sole of the boot upper and different means for locking without a screwing operation into the plastic itself of the boot, adaptable to numerous uses.

FIGS. 1 to 5 show a first embodiment of the invention in which a rigid upper (partially shown) of the ski-boot type comprises an incomplete sole 1 on which a removable sole element 11 can be fixed so as to extend over a front part of the boot to a sufficient degree to include the standard elements under the sole of the boot, such as the bearing plates for the ski-boot soles.

The principle of attaching the removable element 11 relies on the one hand on interaction with the front part 2 of the incomplete sole 1 of the boot upper and, on the other, interaction with a mechanism 3 for fixing and locking the incomplete sole 1 at the rear of the removable element 11. In its front part, the removable element 11 comprises a curb 12 that comprises a vertical inner lip 13 and hooks 14 that interact with complementary forms at the front surface 2 of the incomplete sole 1. This interaction is maintained under pressure by the second fixing means 3 of the two elements 1, 11 arranged under the boot. This second fixing means 3 comprises truncated parts 4 produced in a metal member 5 mounted in rotation in a space 6 of the incomplete sole 1 of the upper of the boot. The spindle 5 is held in its housing by a cover 7 and can be rotated manually or, possibly, with the aid of a thin rigid element such as a coin, via its lateral ends 8. It can occupy two positions: a first position in which the flat of the truncated parts 4 is vertical and allows positioning or removal of the hooks 15 of the removable sole 11 in a location 9 provided in the sole 1; and a second position obtained by a half-turn rotation of the spindle 5 by actuating the end 8, in which the rounded surface at the truncated parts 4 of the spindle 5 comes to bear against the complementary rounded forms of the hooks 15 of the removable sole 11 in order to hold them in their housing 9 and thus to lock the removable sole 11. It is released by means of a further half-turn rotation of the spindle 5 in the opposite direction, a member 10 exerting a pushing force through the effect of a spring compressed on the end part 16 of the removable sole 11, in order to promote its disengagement. As illustrated, in particular, in FIGS. 3 and 4, the removable element 11 represents a very large proportion of the final composite sole, forming, in particular, all the front curb 12 of the boot thus assembled. This solution therefore makes it possible to impose, on the boot finally assembled, the form of its sole and thus the standard to be complied with.

Incidentally, the standard shape of the rear parts of the two ski-boot and hiking-boot soles is very similar and the only change in respect of the front part of the sole allows the two standards substantially to be complied with. In a variant, a further removable sole element may be provided in the rear part and fixed using a locking device similar to that described above.

FIGS. 6 to 20 illustrate three variants of a second embodiment of the invention in which the removable sole extends substantially over the entire incomplete sole of the upper of the boot, being composed of a front part connected to a rear part, it being possible for the two parts to be locked together by a locking mechanism positioned in the central zone under the incomplete sole of the boot upper. In each of these variants, the front and rear parts of the removable sole also interact with the ends of the incomplete sole of the upper, in particular to form standard curbs, in accordance with one of the standards selected (Alpine ski-boot or touring boot).

FIGS. 6 to 10 illustrate a first variant embodiment of such a solution, in which the removable sole 31 is therefore composed of a front sole 32 connected by lateral members 36 to a rear sole 33. Each sole part 32, 33 comprises, toward its ends, hooks 34 that interact with complementary parts 27 of the incomplete sole 21 of the boot, and in its central part a catch 35 capable of interacting with a locking device 23 of the incomplete sole 21 of the boot upper, shown partially in the figures for reasons of clarity. The lateral members 36 are sufficiently flexible to allow the two sole parts 32, 33 to move closer together slightly in order to position the removable sole 31 in its fixing position, in which its hooks 34 interact with the complementary parts 27 of the incomplete boot sole 21. At the front, the latter comprises a front curb part 22, and at the rear a rear curb part 26, forms 27 at the front and at the rear that complement the hooks 34, and in the central zone a locking device 23 for the removable sole 31. This locking device 23 comprises a circular plate 25 mounted in rotation and manually actuable by a button 28 arranged under its lower surface and accessible between the two lateral members 36 connecting the two parts 32, 33 of the removable sole. Longitudinal locking members or rods 24, which are diametrically opposed, are fixed to the periphery of the plate 25 and are guided so as to remain substantially extended in the longitudinal direction of the boot. The functioning of the locking of the removable sole is more precisely shown in FIGS. 8 to 10. The two complementary sole parts 21 and 31 are brought together progressively until they make contact, the rods 24 being in an open position, shown in FIG. 9. When the removable sole has been correctly positioned, a simple quarter-turn rotation of the circular plate 25 makes it possible to extend the rods 24 and to bring them into their locking configuration, illustrated in FIG. 10, in which they assume a position between the catches 35 of the removable sole 31, thus preventing any release of the sole.

In a variant embodiment, the ends of the front and rear parts 32, 33 of the removable sole 31 may have a different form and include, for example, all the front and/or rear curbs in a similar manner to the first embodiment described above. In this variant, the linking members 36 between the two parts 32, 33 of the removable sole 31 are elastic in order for it to be possible for them to be extended during positioning of the removable sole 31, bearing on the front and rear surfaces of the incomplete sole 21 of the boot upper.

FIGS. 11 to 17 illustrate a second variant of this second embodiment, which differs principally in terms of its locking device 23'. The removable sole is also composed of two, front and rear, parts 32', 33', each having an extension 36'*a*, 36'*b* and a locking device 23' provided directly on these extensions. This locking device 23' comprises a lock 25' mounted in rotation about a spindle 26' on an extension 36'*a*, a part 24' of which can interact with a step or tooth 35' of the other longitudinal central extension 36'*b*, thus making it possible to lock the spacing between the two elements 32', 33' of the removable sole held with the ends of the incomplete sole 21' and to prevent longitudinal movement and release thereof.

This variant embodiment advantageously offers an additional level of safety in that it comprises a safety lever 29' that comes to rest on the manual actuation surface 28' of the lock 25' in its locked position in order to hold this position securely. FIG. 12 thus shows the sole in the locking configuration. FIGS. 13 to 17 illustrate different steps in the unlocking of the removable sole. The user begins by actuating the safety lever 29' before he can actuate the lock 25' by pressing on its control surface 28' in order to rotate it about a horizontal, transverse spindle 26' and to release the tooth 35' from the extension 36'*b*, which can then be withdrawn longitudinally rearward.

Figure 18:
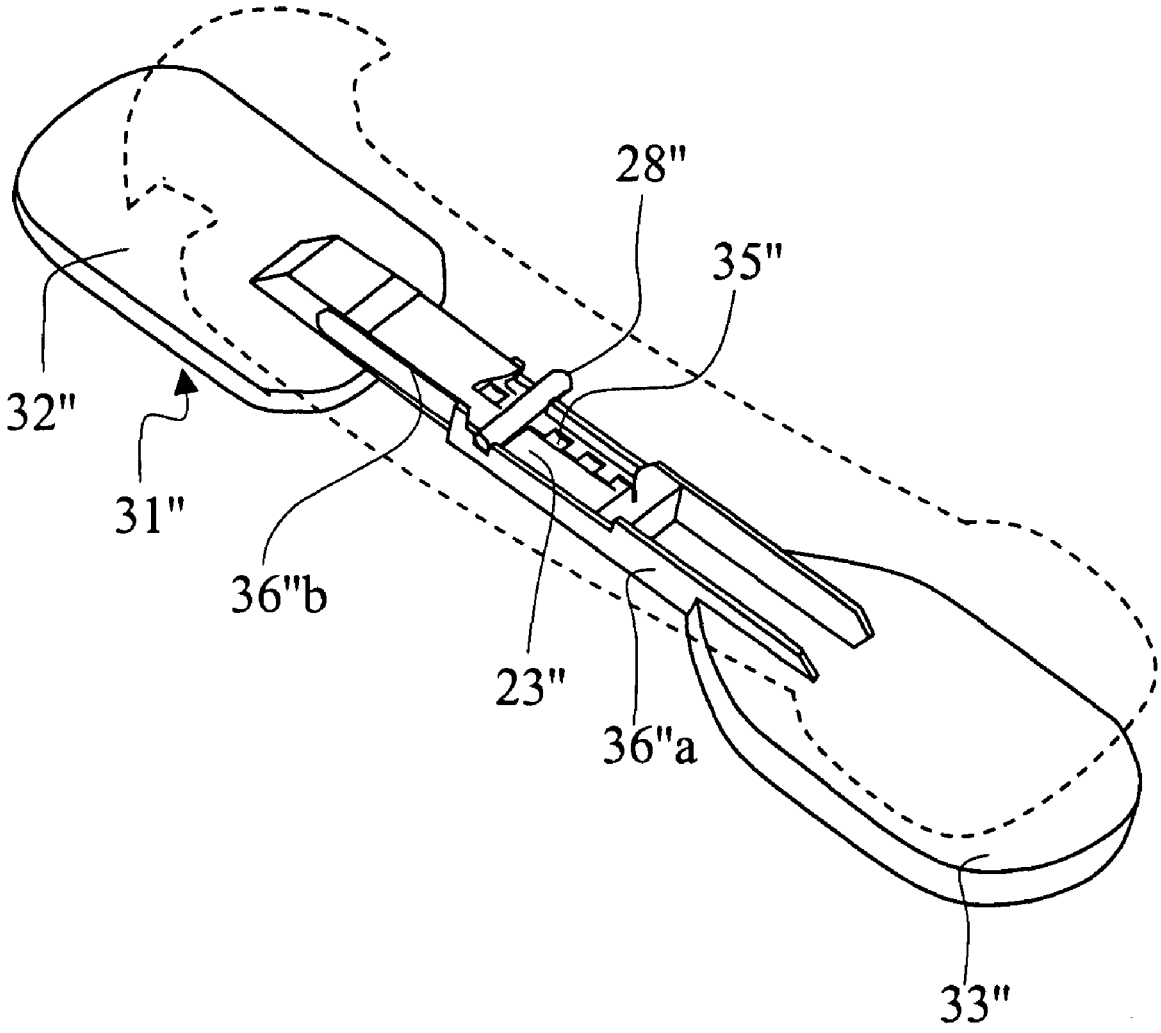
FIG. 18 shows a partial perspective top view of the boot in accordance with a third variant of a second embodiment of the invention.
Figure 19:
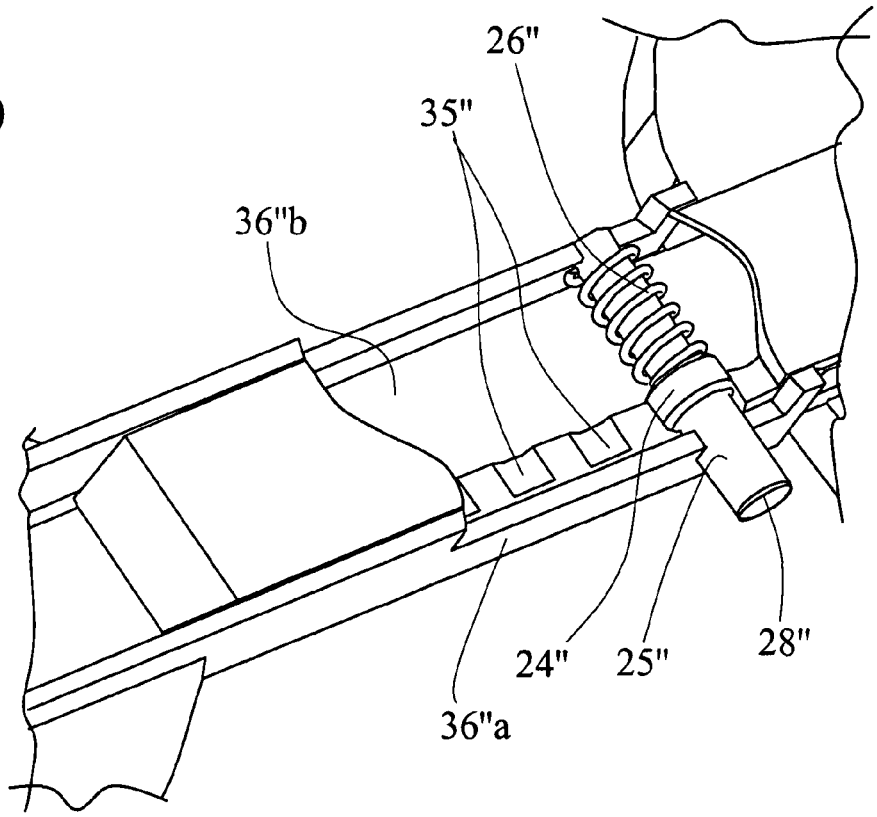
FIGS. 19 and 20 show perspective views of details of the sole-locking device in different configurations in accordance with the third variant of the second embodiment of the invention.
Figure 20:
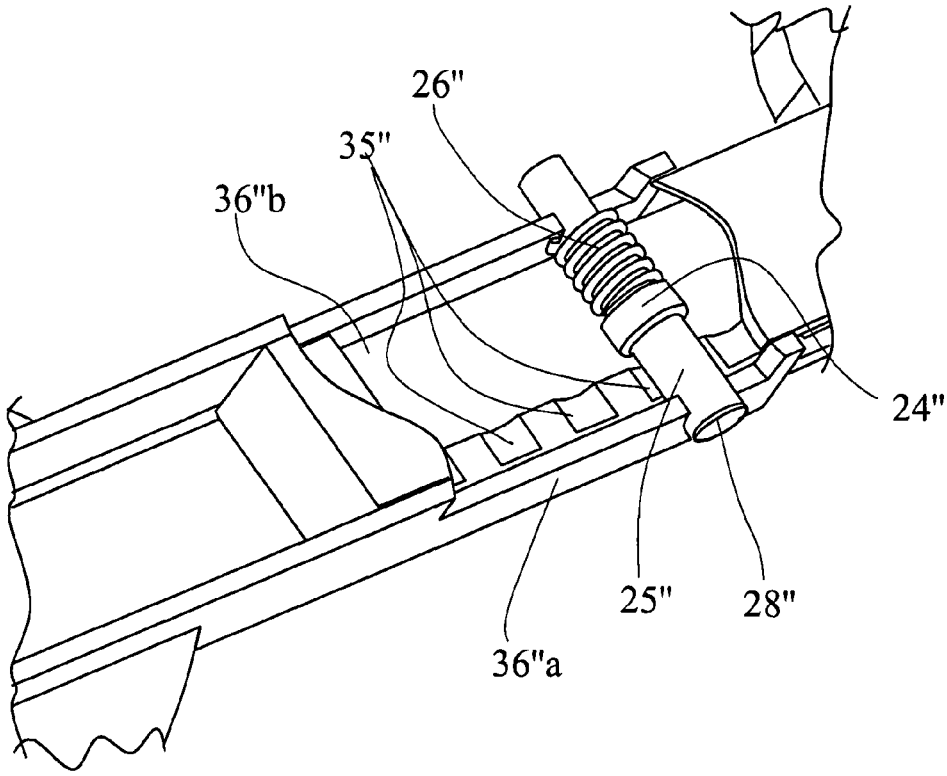

FIGS. 18 to 20 illustrate a third variant of the second embodiment of the invention, in which the removable sole is still composed of two, front and rear parts 32", 33" comprising, respectively, extensions 36'*a* and 36"*b* on which is directly provided a locking means 23", comprising, on the one hand, a member 25" mounted on a first extension 36"*a* so as to be movable in transverse translation, actuable by a button 28" and comprising a ring 24" that is able to interact with one of the circular teeth 35" included within the second extension 36"*b*. FIG. 19 illustrates the device in a locked position. In order to unlock the removable sole, a user presses manually on the button 28" in order to move the member 25" sideways in order to cause the ring 24" to leave the corresponding tooth 35". In this configuration, the extensions 36'*a* and 36"*b* may be moved longitudinally one with respect to the other and the attached sole 31" can thus be removed. The return spring 26" returns the member 25" to the locking configuration and prevents unintentional unlocking.

The last two variants are distinguished from the preceding embodiments in that the locking means 23', 23" is mounted directly on the elements of the removable sole and not on the incomplete sole of the upper. Furthermore, these two solutions offer a supplementary advantage in that it is possible to adjust the length of the removable sole by virtue of regulating the spacing provided between the two, front and rear, parts of the removable sole, which can be locked at different distances from one another, which renders it compatible with boots of different sizes. To that end, a plurality of teeth 35', 35" is provided in each of these variants.

These different solutions have been presented by way of examples, but the concept of the invention may be implemented by means of other configurations, particularly those obtained by combining the different variant embodiments described above. For example, a means for securing the manual actuating means in the locked position of the sole, such as the lever 29' of the variant embodiment illustrated in FIGS. 11 to 17, may also be implemented in all the other variant embodiments.

Lastly, the solution thus satisfactorily achieves the objectives sought and offers the following advantages:

although a single removable-sole assembly 11, 31, 31' or 31" has been shown in the figures for reasons of simplicity, provision is made for two removable-sole assemblies of different geometry that are nevertheless suitable for combination with the incomplete sole 1, 21, 21', 21" of the rigid upper;

thus, a ski boot formed by the use of a first removable-sole assembly may be converted with the aid of a second removable-sole assembly so as to obtain a sole that is substantially compatible with the standard for touring boots, which allows easy walking and optional fastening, under the boot, of standard accessories provided for hiking boots, such as crampons. One and the same boot assembly thus makes it possible to ski in complete safety and also allows an optimum walking mode;

this conversion of the ski sole to a touring sole, and vice versa, is simple and can be carried out anywhere, even without a tool;

one point that the various solutions described share is that they allow conversion based on a fixing means that includes a locking means adapted to a number of situations, i.e. allowing a great many conversion operations such as, for example, several conversions per day of use of the boot, without giving rise to significant wear of the boot's components. This technical effect enables us to call this essential element of the invention, bearing in mind its technical function, a "locking means for numerous uses". Of necessity, this locking means for numerous uses comprises no operation of screwing through the plastic of the boot. One result obtained by means of this technical effect is that it provides a compact boot assembly that can be used for a conversion for each uphill/downhill change. In the case of a solution involving a screwing operation, the user opts for a skiing or walking mode for his boot, which he preserves over a long period of use;

the boot obtained is secured, and the sole is properly locked on and cannot be released accidentally. The fixing achieved is as reliable and as secure as a fixing performed by means of screwing on the removable soles.

The invention claimed is:

1. A boot assembly comprising a rigid upper, of the ski-boot type, provided with an incomplete sole of the upper and comprising at the front or at the rear end, in its lower part, a front or rear cooperation means with a removable sole assembly, and wherein it comprises:

a first removable sole assembly comprising at least one curb part and a bearing plate and a first cooperation means for complementing the front or rear cooperation means of the incomplete sole and for completing the incomplete sole of the upper in order to form a boot with a sole whose configuration corresponds to standard ISO 5355 for Alpine ski-boots;

a second removable sole assembly comprising at least one curb part and a sole cooperation means operable to complement the front or rear cooperation means of the incomplete sole and for completing the incomplete sole of the upper in order to form a boot with a sole whose configuration corresponds substantially to standard ISO 9523 for touring boots; and a locking means operable to lock the first or the second removable sole assembly under the incomplete sole of the upper and comprising a manual actuating means operable to actuate the locking means, wherein the locking means does not comprise an operation of screwing into the plastic of the boot.

2. The boot assembly as claimed in claim 1, wherein the two removable assemblies are positioned at one end of the incomplete sole of the upper and extend to a sufficient degree under the incomplete sole in order to incorporate the standard zones of ski and touring boots.

3. The boot assembly as claimed in claim 1, wherein the removable assemblies extend substantially over the entire length of the boot.

4. The boot assembly as claimed in claim 1, wherein the removable assemblies comprise at least one significant part of the front and/or rear curbs of the boot assembly.

5. The boot assembly as claimed in claim 1, wherein the removable assemblies comprise the cooperation means positioned at their ends, capable of interacting with complementary forms positioned under the incomplete sole of the upper.

6. The boot assembly as claimed in claim 1, wherein the removable soles comprise two parts, front and rear, capable of interacting, respectively, with the front and the rear of the incomplete sole of the upper and connected by at least one linking means positioned in the central zone of the incomplete sole.

7. The boot assembly as claimed in claim 6, wherein the locking means for numerous uses is at least partially linked to the incomplete sole of the upper in the central zone that is the location of the one or more linking means between the two, front and rear, parts of the removable sole.

8. The boot assembly as claimed in claim 6, wherein the locking means for numerous uses is linked directly to the one or more linking means between the two, front and rear, parts of the removable sole independently of the incomplete sole of the upper.

9. The boot assembly as claimed in claim 8, wherein the two, front and rear, parts of the removable sole may be locked at different spacings in order to adapt to boots of different sizes.

10. The boot assembly as claimed in claim 8, wherein the locking means is mounted on two extensions of the two, front and rear, parts of the removable sole, comprises a lock mounted in rotation about a horizontal and transverse spindle of a first extension, which can be actuated manually by a button, the lock being able to occupy a first, open position and a second, locking position in which it interacts with a tooth of the second extension of the removable sole in order to lock it.

11. The boot assembly as claimed in claim 8, wherein the locking means is mounted on two extensions of the two, front and rear, parts of the removable sole, the locking means comprising a member mounted on the first extension so that it can move in transverse translation, which can be actuated by a button on one end, and comprising a ring on its circumference, the member being able to occupy a first, open position and a second, locking position in which the ring interacts with a circular tooth of the second extension of the removable sole in order to lock it.

12. The boot assembly as claimed in claim 11, wherein the member is subject to a return spring that tends to push the member into its locking position.

13. The boot assembly as claimed in claim 6 wherein the locking means comprises a circular plate mounted in rotation under the surface of the incomplete sole of the upper, which can be actuated manually by a button, at least one longitudinal rod fixed toward the periphery of the plate and guided so as to remain substantially extended in the longitudinal direction of the boot, in order to be able to occupy two positions, a first, open position in which it does not interact with a removable sole and a locking position in which it extends until it interacts with a catch of the removable sole, which is thus locked, and wherein two rods are mounted on the plate in a diametrically opposite manner in order to interact with two catches positioned, respectively, on the front and rear parts of the removable sole, wherein the two, front and rear, parts are linked by two linking members positioned laterally, and wherein the button of the locking means is accessible under the surface of the boot between these two linking members.

14. The boot assembly as claimed in claim 1, wherein the locking means comprises a circular plate mounted in rotation under the surface of the incomplete sole of the upper, which can be actuated manually by a button, at least one longitudinal rod fixed toward the periphery of the plate and guided so as to remain substantially extended in the longitudinal direction of the boot, in order to be able to occupy two positions, a first, open position in which it does not interact with a removable sole and a locking position in which it extends until it interacts with a catch of the removable sole, which is thus locked.

15. The boot assembly as claimed in claim 14, wherein two rods are mounted on the plate in a diametrically opposite manner in order to interact with two catches positioned, respectively, on the front and rear parts of the removable sole, wherein the two, front and rear, parts are linked by two linking members positioned laterally, and wherein the button of the locking means is accessible under the surface of the boot between these two linking members.

16. The boot assembly as claimed in claim 1, which also comprises a securing means operable to secure the actuating means in the locking position so as to prevent its accidental actuation.

17. The boot assembly as claimed in claim 1, wherein the locking means comprises a manual actuating means that needs no tool.

18. The boot assembly as claimed in claim 1, wherein the locking means comprises a manual actuating means for rotating at most one half-turn of a locking element or a translation of at most a few millimeters of a locking element.

19. A boot assembly comprising a rigid upper, of the ski-boot type, provided with an incomplete sole of the upper and comprising at the front or at the rear end, in its lower part, a front or rear cooperation means with a removable sole assembly, and wherein it comprises:

a first removable sole assembly comprising at least one curb part and a bearing plate and a first cooperation means for complementing the front or rear cooperation means of the incomplete sole and for completing the incomplete sole of the upper in order to form a boot with a sole whose configuration corresponds to standard ISO 5355 for Alpine ski-boots;

a second removable sole assembly comprising at least one curb part and a sole cooperation means operable to complement the front or rear cooperation means of the incomplete sole and for completing the incomplete sole of the upper in order to form a boot with a sole whose configuration corresponds substantially to standard ISO 9523 for touring boots; and a locking means operable to lock the first or the second removable sole assembly under the incomplete sole of the upper and comprising a manual actuating means operable to actuate the locking means, wherein the locking means comprises a spindle comprising at least one truncated part mounted movably in rotation in a space provided under the surface of the incomplete sole of the upper, which can be actuated manually by means of its lateral ends, it being possible for it to occupy a first, open position in which the truncated part frees a space for positioning the removable sole and a second, locking position in which the flat formed by the truncated part interacts with an extension of the removable sole in order to lock it.

20. A boot assembly comprising a rigid upper, of the ski-boot type, provided with an incomplete sole of the upper and comprising at the front and/or rear end, in its lower part, a front and/or rear means for cooperation with a removable sole assembly, and further comprising:

a first removable sole assembly comprising at least one curb part and a bearing plate and a cooperation means that complements the front and/or rear cooperation means of the incomplete sole, capable of completing the incomplete sole of the upper in order to form a boot with a sole whose configuration corresponds to a ski-boot sole and is made from a rigid material for providing a good link with a ski binding;

a second removable sole assembly comprising at least one curb part and a sole cooperation means that complements the front and/or rear cooperation means of the incomplete sole, capable of completing the incomplete sole of the upper in order to form a boot with a sole whose configuration corresponds to a touring boot, having a surface made from a flexible material forming studs on its underside in order to provide good grip on the ground, and having a rounded front shape in order to allow satisfactory rolling of the foot; and a locking means for numerous uses in order to lock the first or the second removable sole assembly under the incomplete sole of the upper and comprising a manual actuating means, this locking means being positioned in the central zone under the incomplete sole of the boot upper wherein the locking means does not comprise an operation of screwing into the plastic of the boot.

* * * * *